United States Patent [19]

Capek

[11] Patent Number: 4,684,905

[45] Date of Patent: Aug. 4, 1987

[54] LOAD-BEARING DETENT MECHANISM

[75] Inventor: George Capek, Frederick, Md.

[73] Assignee: Weinschel Engineering, Gaithersburg, Md.

[21] Appl. No.: 763,774

[22] Filed: Aug. 5, 1985

Related U.S. Application Data

[63] Continuation of Ser. No. 561,171, Dec. 14, 1983, abandoned.

[51] Int. Cl.[4] ..... H01P 1/22; G05G 5/06

[52] U.S. Cl. ..... 333/81 R; 333/81 A; 74/527

[58] Field of Search ..... 74/531, 527, 10.41; 333/81 A, 81 R; 200/291

[56] References Cited

U.S. PATENT DOCUMENTS

| | | | |
|---|---|---|---|
| 1,512,362 | 10/1924 | Phelps . | |
| 2,444,592 | 7/1948 | Creson | 74/531 X |
| 3,000,231 | 9/1961 | Cochran . | |
| 3,157,846 | 11/1964 | Weinschel | 333/81 |
| 3,208,017 | 9/1965 | Brown et al. | 74/531 X |
| 3,242,762 | 3/1966 | Durand et al. . | |
| 3,311,718 | 3/1967 | Allison et al. . | |
| 3,470,333 | 9/1969 | Schneider et al. | 200/291 X |
| 3,570,325 | 3/1971 | Kroll et al. | 74/527 |
| 3,622,919 | 11/1971 | Wilholt | 333/81 |
| 3,709,570 | 6/1973 | Galbato . | |
| 3,824,506 | 7/1974 | Bacher | 333/81 A |
| 3,884,087 | 5/1975 | Sakaki . | |
| 4,011,531 | 3/1977 | Gaudet | 333/81 A |
| 4,038,508 | 7/1977 | Mapelsden | 74/531 X |
| 4,107,634 | 8/1978 | Scaletta et al. | 333/81 A |
| 4,182,939 | 1/1980 | Feaster | 200/291 X |
| 4,354,069 | 10/1982 | Ragen | 200/291 X |
| 4,441,000 | 4/1984 | Suwa | 200/291 |

FOREIGN PATENT DOCUMENTS

| | | | |
|---|---|---|---|
| 2230856 | 1/1974 | Fed. Rep. of Germany | 200/291 |
| 582687 | 11/1946 | United Kingdom | 74/527 |

*Primary Examiner*—Gary L. Smith
*Assistant Examiner*—Rodney M. Lindsey
*Attorney, Agent, or Firm*—Hall, Myers & Rose

[57] ABSTRACT

An attenuator device is disclosed defined by an inner member having an outer cylindrical surface and a coaxial and relatively rotatable outer member having an inner cylindrical surface. Longitudinally extending grooves are defined in the respective surface of each member. Attenuating structure is disposed in the longitudinal length of the grooves of one of the members while bowed leaf springs are disposed in the longitudinal length of the grooves of the other member. The bowed leaf springs extend from the grooves of the other member to engage the grooves and attenuating structure of the one member to thus provide both detenting and grounding for the attenuator device.

30 Claims, 9 Drawing Figures

LOAD-BEARING DETENT MECHANISM

This is a continuation of application Ser. No. 561,171 filed Dec. 14, 1983, now abandoned.

FIELD OF INVENTION

This invention relates to detents and more particularly to detents for load bearing devices. This device is particularly useful as a detent mechanism which steps from one registered, or locked, angular position to another, especially in a barrel or turret attenuator.

BACKGROUND OF THE INVENTION

Spring actuated detent mechanisms have long been employed for a variety of mechanical and electrical structures. Among some more notable uses of detents, are control of electrical switching and rotational registration. For instance, Durand, in U.S. Pat. No. 3,242,762, illustrates a rotary switch including spring actuated levers coacting with circumferentially spaced camming pins to register shaft rotation and activate micro switches.

In the context of shaft load bearing, Sakaki, U.S. Pat. No. 3,884,087 teaches a rotary heat regenerator including circumferentially, equidistantly spaced, arcuate recesses having plate springs disposed therein to clutch two spaced rotating members. Several other devices employ annular grooves and complementary leaf springs as illustrated by Cochran in U.S. Pat. No. 3,000,231 and Phelps 1,512,362.

In the context of registration, a patent to Bacher (U.S. Pat. No. 3,550,046) discloses a step attenuator employing a detent registration element for properly aligning coaxial circuits. Like other prior art devices disclosed herein, the detent of Bacher functions along a single tangential vector.

The above-noted and other prior art devices generally possess particular structures designed for particular purposes. For example, prior mechanisms generally relate to either a form of registration or a flexible mechanical coupling. Sometimes, however, it is desirable to employ a single device which satisfies both of these functions. Moreover, at times, it is desired to also provide positive electrical grounding of the rotatable member in detenting a switchable attenuator or the like. The prior art does not teach a detent mechanism which employs the same elements to achieve these various objects.

SUMMARY OF THE INVENTION

Therefore, it is an object of the present invention to overcome the design limitations of the prior art.

It is a further object of this invention to provide a device which will perform the functions of registration and load bearing simultaneously, as well providing grounding as desired.

Another object of this invention is to provide a device which is satisfactory for a broad range of uses.

These and other objects are satisfied by providing a device including a first cylinder encircled by and coaxial with a second cylinder, the two cylinders being rotatable relative to each other about their common axis. The first cylinder preferably includes at least five circumferentially equidistantly-spaced, longitudinally extending grooves and the second cylinder similarly includes at least five members which engage the grooves to register the second cylinder with said first cylinder at prescribed angular positions. The same members also maintain the spacing between the cylinders. That is, the members permit the cylinders to be rotated from one registered position to another while remaining centered along a common axis.

The device disclosed herein may be employed in a number of environments. In the electrical art, it provides a switchable barrel attenuator of remarkable durability and accuracy. When employed in the mechanical arts as a flexible coupling for a rotating shaft, the device features superior detenting and load bearing. In addition, the device reduces wear and the need for replacement relative to prior detent devices.

Moreover, of particular significance, it has been noted that certain prior barrel attenuators have experienced grounding problems. In particular, at high values of attenuation, leakage around the barrel has been significant. The leaf springs of the present invention short out the leakage energy and thereby alleviate the problem. Hence, at high frequencies in particular the by-pass capacitance between the inner and outer cylinders in the barrel or turret attenuator is greatly reduced by means of the ground conductors.

DETAILED DESCRIPTION OF PREFERRED EMBODIMENTS

Figure 1:
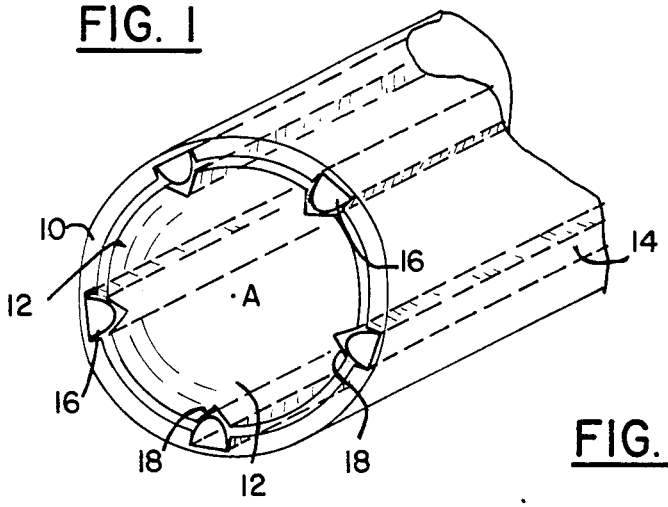
FIG. 1 is a perspective view of one preferred embodiment of this invention.

FIG. 1 shows an outer cylinder 10 and an inner cylinder 12. The cylinders share the same rotational axis A. In accordance with the invention, cylinder 10 remains stationary while cylinder 12 rotates about the axis A. It is, however, contemplated that both 10 and 12 may rotate or that cylinder 10 remain stationary. Elongated recesses 14 are machined or milled along the inner circumference of cylinder 10. In order to provide proper support and registration, five recesses are located at equal distances around the inner circumference of cylinder 10. The recesses are rectangular in order to secure flexible leaf springs 16 therealong. The springs 16 must be wide enough so that when secured in recesses 14, they protrude beyond the inner peripheral surface of cylinder 10. The springs 16 may be manufactured of any suitable material which possesses the requisite durability and resiliency for effective and long term operation.

When used as an electrical device, particularly an attenuator, the springs 16 are manufactured from an electrically conductive material. For this purpose, springs manufactured from Beryllium-Copper alloys or metals possessing similar characteristics have been found to exhibit excellent conductive qualities as well as resiliency and durability.

Along the inner cylinder 12 are grooves 18 made by any conventional technique. The grooves 18 are dimensioned and spaced to receive the leaf springs 16 of outer cylinder 10 much in the fashion of a tongue and groove when the cylinders 10 and 12 are in a registered position. Therefore, the grooves 18 are located at equidistances around the circumference of inner cylinder 10 in conformance with the spacing of the springs 16 on the outer cylinder 12. Preferably, the number of grooves equals the number of leaf springs positioned along the shaft 10. However, the number of machined grooves employed may be determined by the particular use of the device. For instance, when five springs are used, ten equally spaced grooves may be employed. Such a modification maximizes detent registrations from a single rotation. Moreover, in the context of interchangeable parts, the characteristic of substituting multiples on either the outer or inner cylinders minimizes the need for a multiplicity of parts to obtain a variety of parameters.

Figure 2:
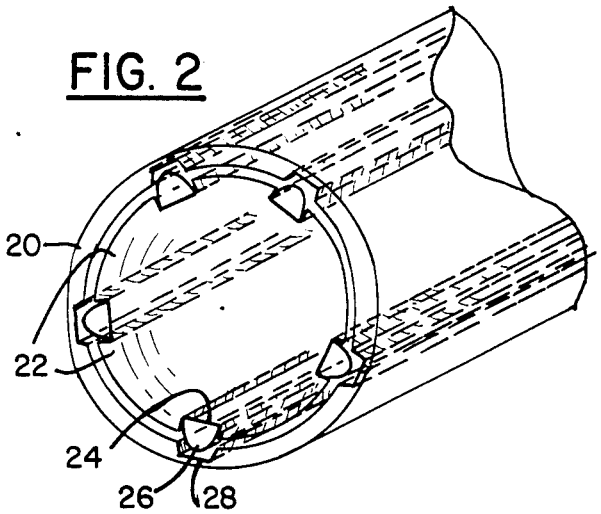
FIG. 2 is a perspective view of a second preferred embodiment.

FIG. 2 illustrates a second preferred embodiment. In this case, outer shaft 20 includes grooves 28. Inner shaft 22, therefore, incorporates recesses 24 into which leaf springs 26 are secured. This embodiment merely illustrates a reversed arrangement as that shown in FIG. 1.

Figure 3:
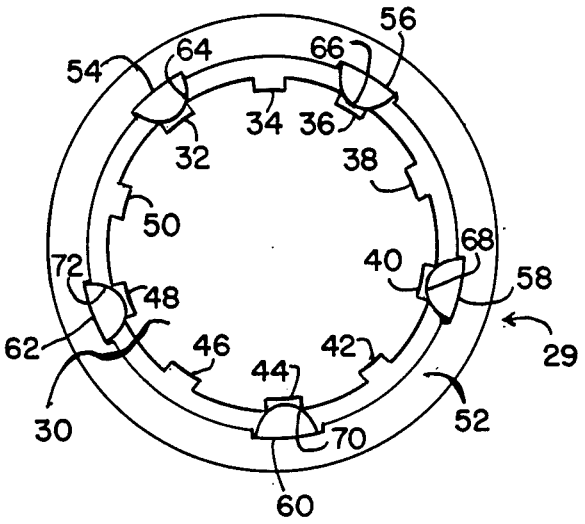
FIG. 3 is a front view of one embodiment.

Referring to FIG. 3, a specific detent mechanism 29 is shown. An inner cylinder 30 has ten longitudinally extending grooves 32 through 50 defined at equal spaces thereabout. An outer cylinder 52 has five longitudinal recesses 54 through 62 equally spaced thereabout. Along each recess 54 through 62 is a corresponding leaf spring 64 through 72. With the five leaf springs 64 through 72, ten indexed or register positions are provided. Sample normalized dimensions for the detent mechanism 29 are set forth as follows below (preferably in inches). The outer diameter of the inner cylinder is 0.810. The angular width of each groove 32 through 50 is 0.078 and the depth thereof is 0.007. Each recess 54 through 62 is 0.240 wide and is 0.007 deep. Each leaf spring 64 through 72 has a bowed width of 0.240 (corresponding to the recess width) and protrudes a distance of 0.035 prior to engaging a groove. The inner diameter of the outer cylinder 52 is defined to enable the detent mechanism to be rotated from one registered position to another. The springs are preferably 0.002 thick. The thickness may be varied, however, to alter the torque required to effect rotation. In addition, the number of springs insertable into corresponding recesses may be varied to again alter the torque required for rotation. The grooves 32 through 50 are spaced at equal 36° angular intervals and the recesses 54 through 62 are spaced at equal 72° angular intervals. The length of the detent mechanism 29 depends on application.

Figure 4:
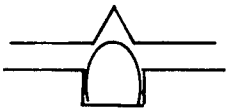
FIGS. 4 through 6 are illustrations showing various relationships between the springs and coacting grooves surfaces.
Figure 5:
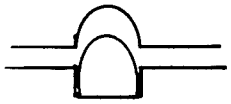
Figure 6:
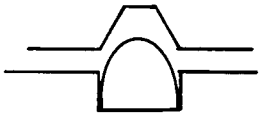

FIGS. 4 through 6 illustrate some of the various configurations of the grooves employed for the present invention. More particularly, FIG. 4 illustrates a beveled groove of 120°, having a v-shaped cross-section. FIG. 5 represents a groove with a curved u-shaped cross-section which the springs engage and FIG. 6 depicts a groove with a trapezoidal u-shaped cross-section.

A device manufactured in accordance with this invention with five springs and coacting grooves has been rotated at 150 steps per minute (30 rpm). Moreover, the device has exhibited insignificant wear after 2.6 million steps (520,000 revolutions) and has retained accuracy thereafter.

Figure 7:
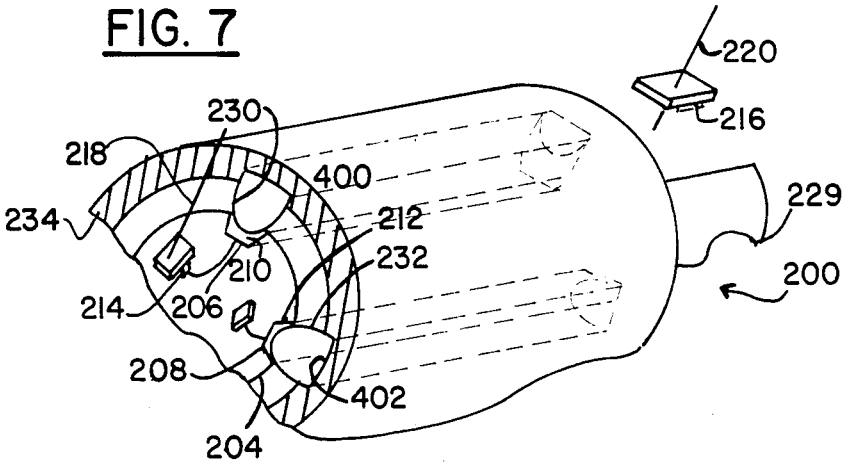
FIG. 7 is a perspective view of part of a switchable attenuator employing a detent mechanism according to the invention.

Referring now to FIG. 7, a portion of a switchable attenuator 200 is shown employing the detent mechanism of the invention. Specifically, the attenuator 200 has an inner cylinder 204 provided with a plurality of angularly spaced grooves extending longitudinally therealong; only two of which, 206 and 208 being illustrated. Each groove 206 and 208 has a corresponding attenuator strip 210 and 212, respectively, extending therealong. Preferably, each strip 210 and 212 lies along the surface of each respective groove 206 and 208. At each end of groove 206 is a respective contact member 214 and 216 positioned to make contact with signal carrying members 218 and 220 respectively. The signal carrying members 218 and 220 are fixed in position and, depending on the angular position of the cylinder 204, have a selected one of the attenuator strips (e.g. 210 or 212) connected therebetween. As shown in FIG. 7, the signal carrying member 218 is in contact with contact member 214 and the signal carrying member 220 is in contact with contact member 216. The attenuator strip 210 is thus in an operative position, i.e. connected between the signal carrying members 218 and 220, and a signal on the signal carrying members 218 and 220 passes through and is attenuated by the strip 210 according to its value.

Still referring to FIG. 7, bowed and elongated leaf springs 230 and 232 are shown positioned along recesses (see FIG. 8) in an outer hollow cylinder 234. The hollow cylinder 234 preferably has a circular cross-section which encircles the inner cylinder 204 which also has a preferably circular cross-section. The leaf springs 230 and 232 are positioned at angular intervals along the inner surface of the cylinder 234 in correspondence with the angular spacing of the grooves, e.g. 206 and 208, on the outer surface of the cylinder 204. In accordance with the FIG. 7 embodiment, the inner cylinder 204 and the outer cylinder 234 are rotable relative to each other about a common axis. A shaft 229 is coupled to the inner cylinder 204 so that it may be rotated relative to a stationary outer cylinder 234. A conventional device (not shown)may rotate the shaft 229 in steps as desired. Because the leaf springs, e.g. 230 and 232, are spaced in correspondence with the grooves, e.g. 206 and 208, the inner cylinder 204 and outer cylinder 234 may be rotated to a plurality of angular positions whereat at least one leaf spring engages a groove to provide a fixed relative position between cylinders 204 and 234.

Figure 8:
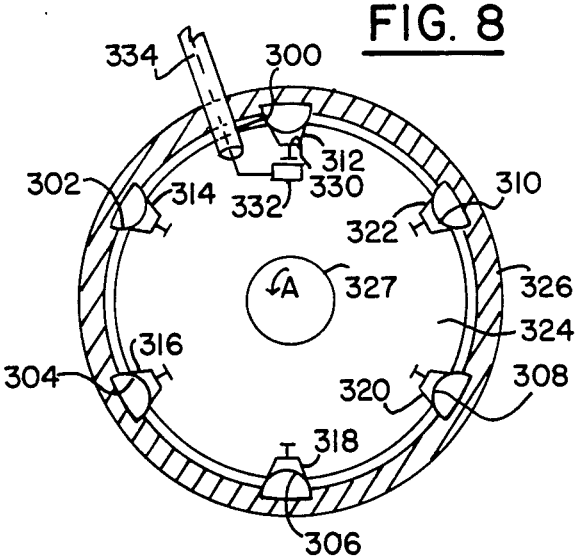
FIG. 8 is a front view illustration of one embodiment of a switchable attenuator employing a detent mechanism according to the invention.

Preferably, as shown in FIG. 8, leaf springs 300 through 310 are equally spaced as are the grooves 312 through 322. In FIG. 8, the spacing is 60°. As the inner cylinder 324 and the outer cylinder 326 are rotated at 60° increments relative to each other about axis A, by rotation of a shaft 327, each leaf spring 300 through 310 engages one groove 312 through 322 after another to connect one attenuator (e.g. 330) after another between signal carrying members (e.g. 334).

The resilience of the leaf springs 300 through 310 provides not only easy rotation but also firm engagement of each groove 312 through 322 at registered positions.

Referring again to FIG. 7, it is to be noted that the leaf springs 230 and 232 serve a purpose in addition to the detenting. Each leaf spring 230 and 232 also acts as a ground conductor connected to an attenuator strip 210 or 212 along a groove floor. As noted in U.S. Pat.

No. 3,824,506, the attenuator strip 210 represents both a series resistance and a shunt resistance. The leaf spring 230—as a ground conductor—is connected to the attenuator strip 210 along the side walls of the groove 206 or by other means as desired to effectuate the above-mentioned resistive structure. To serve as a ground conductor, the leaf spring 230, for example, is connected to ground relative to signal carrying member 218 in a conventional fashion. By way of example, assuming member 218 to be a coaxial cable, the leaf spring 230 is connected to the outer conductor thereof—the inner conductor thereof being disposed to contact the contact member 214. A specific teaching of connecting a ground conductor to a coaxial outer conductor is discussed in U.S. Pat. No. 4,107,634 to Scaletta and Capek, the teachings of which are incorporated herein by reference.

Turning again to FIG. 8, it is observed that the attenuator strip 330 along the floor of groove 312 is in an operative position connected through a contact member 332 to a conductor 334. The spring 300 is grounded by any convenient mechanism. Measurements with the attenuator 330—such as calibrating the attenuator 330—can be made. As desired, another attenuator may be rotated into the operative position and measurements can then again be made.

When the springs 300 through 310 engage grooves 312 through 322 (as shown in FIG. 8), one attenuator is fixedly registered in the operative position. The resistance of the attenuator is thus maintained constant and measurements—such as calibration—may be effectively made.

In FIGS. 7 and 8, then, a barrel attenuator is provided which employs the detent mechanism of the invention. One attenuator strip after another may be placed into the operative position as the barrel rotates from one registered position to another. As noted previously, the leaf springs which serve as part of the detent mechanism also serve as ground conductors which are connectable to the attenuators. This dual functioning aspect of the leaf springs enables the present invention to operate without separate grounding conductors and detent mechanisms as set forth in U.S. Pat. No. 4,107,634. Hence, a barrel attenuator featuring a reduction of parts as well as a barrel attenuator which can rotate over 2,600,000 steps with fixed registration and which provides good centering of the barrel within the outer cylinder—to save bearings and achieve smooth rotation—is provided, especially where the number of springs and grooves are equal and where the angular interval between each pair of adjacent springs and between adjacent grooves is the same.

Moreover, of particular significance, it has been noted that certain prior barrel attenuators have experienced grounding problems. In particular, at high values of attenuation, leakage around the barrel has been signficant. The leaf springs of the present invention short out the leakage energy and thereby alleviate the problem. Hence, at high frequencies in particular the by-pass capacitance between the inner and outer cylinders in the barrel or turret attenuator is greatly reduced by means of the ground conductors.

In accordance with the invention, either the inner cylinder 204 (see FIG. 7) or the outer cylinder 234 may be fixed in position—the other cylinder being rotatable about axis A to effect indexing or registration of the detent mechanism from one angular position to another. In this regard, it is further pointed out that—as suggested previously—the ground springs 230 and 232 may alternatively be positioned along the inner cylinder 204 and the grooves 206 and 208 may then be positioned along the outer cylinder 234. The operation of rotating attenuator strips 210 or 212 into the operative position remains substantially the same. The ground springs 230 and 232 still also provide detent, grounding, leakage reduction and load-bearing—and inner cylinder centering—functions.

Furthermore, it is noted that the number of grooves and spacing therebetween need not correspond with the number of leaf springs and spacing therebetween, although such equality is preferable.

In addition, it is observed that leaf springs 230 and 232 are disposed along recesses 400 and 402 in the cylinder 234. Any number of such recesses may be angularly positioned about the cylinder 234 to allow any number of leaf springs to be inserted therein. That is, twelve recesses may be provided with leaf springs being positioned in one through twelve of such recesses. This feature adds flexibility to the detent mechanism, enabling a user to select the number and angular positions of detent registering.

As noted previously, the grooves 206 and 208 may have v-shaped, rounded u-shaped, square-cornered or trapezoidal u-shaped, or other cross-sections. In any case, each groove preferably includes an appropriate attenuator element therealong and is dimensioned to engage a leaf spring and provide a grounding function as discussed above.

Further, as an alternative, the inner cylinder (e.g. 204) may be held stationary while the outer cylinder (e.g. 234) is rotated by some conventional means.

It is also noted that attenuator elements of varying types may be employed to operate the same as and to substitute for the attenuator strips specifically referred to with regard to FIGS. 7 and 8.

Figure 9:
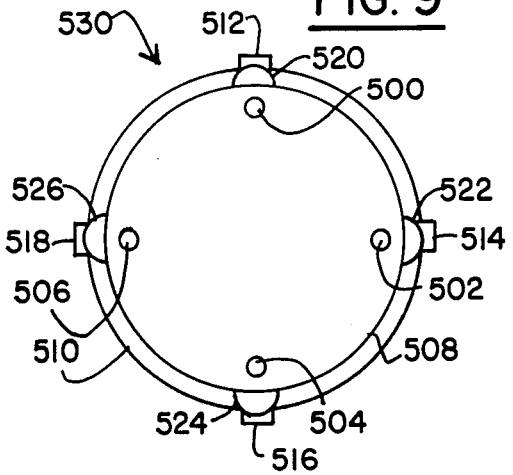
FIG. 9 is a front view illustration of another embodiment of a switchable attenuator employing a detent mechanism according to the invention.

Moreover, it is contemplated that, as in FIG. 9, attenuator elements 500 through 506 may comprise members which are disposed along angularly spaced longitudinal bores in an inner cylinder 508—as is depicted in U.S. Pat. No. 3,228,099 to Veteran which is incorporated herein by reference. Like bullets in the cylinder of a revolver gun, one attenuator element after another may be rotated into the operative position as shown in the Veteran patent. Encircling the inner cylinder is a hollow outer cylinder 510 as taught above. One of the two cylinders, e.g. 510, has longitudinal grooves, 512 through 518, therealong and the other, e.g. 508, has complementary, longitudinally extending leaf springs, 520 through 526. The grooves and springs are angularly spaced so that relative rotation of the two cylinders provides locking at positions whereat an attenuator element 500 through 506 is in the operative position. The leaf springs 520 through 526 serve as ground springs for the device 530 in that the inner cylinder 508 comprises a conductive material for connecting the attenuator elements to ground (on the outer cylinder 510) to reduce leakage.

According to the invention, the inner cylinder and outer cylinder preferably comprise Aluminum, one of the cylinders having the leaf springs protruding therefrom. Alternatively, the inner cylinder may comprise a shaft of stainless steel and the outer cylinder may comprise a housing member of Aluminum--where the housing member may have any desired structure provided it has a cylindrical inner surface encircling the shaft.

In accordance with the invention, bushings, bearings, and ground connectors are obviated where the leaf springs serve the functions of these elements.

Other objects, features and advantages of the invention will become apparent from the following description of preferred embodiments as disclosed hereunder in conjunction with the drawings. Variations and modifications of this invention may be devised without departing from the spirit and scope of this disclosure.

I claim:

1. In a switchable attenuator device having a plurality of attenuators selectively rotatable to an operative position, a load-bearing detent mechanism for registering the attenuator device when an attenuator is rotated to the operative position, the load-bearing detent mechanism comprising:

an axially elongated inner member having an outer cylindrical surface;

an axially elogated outer member having an inner cylindrical surface wherein said inner cylindrical surface is coaxial with and encircles said outer cylindrical surface and wherein said inner member and said outer member are rotatable relative to each other; and said surfaces having on the juxtaposed surfaces a plurality of grooves extending substantially the lengths of said members parallel to their common axis with the grooves on each surface disposed at angular positions relative to each other groove on that surface about the periphery of the surface;

a conductive leaf spring having a bow in a plane perpendicular to the axis of said members disposed in each of said grooves in one of said surfaces, the bow in said leaf spring protruding sufficiently to engage and seat in a groove in said other member, each of said springs extending the length of its associated groove, and means for electrically grounding each end of each of said leaf springs, wherein said attenuator in said operative position forms a portion of an electrical circuit by the creation of electrical connections at each end of said attenuator when said attenuator is rotated into its operative position, and means for rotating said members relative to one another.

2. A load-bearing detent mechanism according to claim 1 wherein said leaf spring means comprises:

at least three leaf springs angularly spaced about a first of the two cylindrical surfaces, said three leaf springs protruding from said first cylindrical surface toward and against the second cylindrical surface;

said second cylindrical surface having a plurality of angularly spaced grooves therealong, each groove having a corresponding attenuator disposed thereon;

each of at least some of said leaf springs engaging a groove when said inner member and said outer member are at each of the prescribed relative angular positions, said leaf springs being releasable from engagement responsive to relative rotation of said inner member and said outer member;

said leaf springs being positioned to (a) maintain a substantially uniform annular spacing between said outer cylindrical surface and said inner cylindrical surface and (b) connect the attenuator of a groove engaged by a leaf spring to ground.

3. A load-bearing detent mechanism according to claim 2 wherein the attenuator device includes a signal carrying element for conveying a signal to the attenuator in the operative position; and wherein an attenuator in the operative position attenuates a signal from the signal carrying element, the attenuator in the operative position being shunted to ground through the leaf spring engaging the groove on which the attenuator in the operative position is disposed.

4. A load-bearing detent mechanism according to claim 3 wherein said at least three leaf springs comprise m leaf springs positioned at angular intervals where m is an integer $3 \leqq m$;

said second cylindrical surface having n grooves therearound positioned at angular intervals where n is the same as or an integer multiple of m.

5. A load-bearing detent mechanism according to claim 4 wherein m and n are equal and said leaf springs are spaced at angular intervals of 360°/m and the grooves are spaced at angular intervals of 360°/n.

6. A load-bearing detent mechanism according to claim 5 wherein said first cylindrical surface comprises said outer cylindrical surface.

7. A load-bearing detent mechanism according to claim 5 wherein said first cylindrical surface comprises said inner cylindrical surface.

8. A load-bearing detent mechanism according to claim 6 wherein said outer member comprises an electrically conductive material connected to electrical ground.

9. A load-bearing detent mechanism according to claim 4 further comprising:

means for selectively varying the torque required for providing relative rotation said varying means including:

said first cylinder surface having a plurality p of recesses angularly spaced therearound, where p is an integer, $3 \leqq p$; and each leaf spring being selectively insertable and removable from each recess, the number of leaf springs inserted thereby defining the value of m.

10. A load-bearing detent mechanism according to claim 9 wherein m equals to five and n equals five and p is at least five.

11. A load-bearing detent mechanism according to claim 4 wherein m equals to five and n equals five and p is at least five.

12. A load-bearing detent mechanism according to claim 9 wherein said varying means further comprises:

said first cylinder surface wherein the recesses therein are dimensioned to receive leaf springs of different dimensions and resilience.

13. A load-bearing detent mechanism according to claim 5 wherein said leaf springs and the grooves extend longitudinally substantially the entire length of said first cylindrical surface and said second cylindrical surface respectively.

14. A load-bearing detent and electrical grounding mechanism for an electrical device wherein said detent mechanism provides and maintains uniform spacing between inner and outer cylinders, said detent and electrical grounding mechanism comprising;

a first elongated cylindrical member providing a first cylindrical surface, a second elongated cylindrical member providing a second cylindrical surface coaxial with said first cylindrical surface, one of said members being disposed about the other of said members, said members being rotatable relative to one another, said members having on their juxtaposed surfaces a plurality of grooves extending substantially the lengths of said members parallel to their axis with the grooves on each surface disposed at angular positions relative to each other groove on that surface about the periphery of the surface, a conductive spring having a bow in a plane perpendicular to the axis of said members disposed in each of the grooves in the surface of one of said members, the bow in said spring protruding sufficiently to engage and seat in said groove in said other member, means for connecting each of said springs to an electrical ground, at least one attenuator means mounted on said first or said second cylindrical member, means for selectively rotating said at least one attenuator means into an operative position wherein said attenuator means forms a portion of an electrical circuit, each of said bowed springs extending substantially the length of its associated groove and means for rotating one of said members relative to the other.

15. A load-bearing detent and electrical grounding mechanism for an electrical device according to claim 14 wherein said springs of said one of said members are disposed at equal regular intervals of 360°/m where m is an integer $3 \leqq m$; and wherein said other member has n grooves positioned at equal angular intervals of 360°/n where n is the same as or an integer multiple with m.

16. A load-bearing detent mechanism according to claim 15 wherein m equals five and n equals five.

17. A load-bearing detent and electrical grounding mechanism for an electrical device according to claim 14 further comprising;

means for connecting said springs to an electrical ground wherein at least one of said members is conductive.

18. A load-bearing detent and electrical grounding mechanism for an electrical device according to claim 17 wherein both said members are conductive.

19. A load-bearing detent mechanism according to claim 14 wherein said first cylindrical surface comprises said inner cylindrical surface.

20. A load-bearing detent mechanism according to claim 14 wherein said first cylindrical surface comprises said outer cylindrical surface.

21. A load-bearing detent mechanism according to claim 14 wherein said leaf springs comprise beryllium-copper alloy leaf springs.

22. A load-bearing detent mechanism according to claim 14 wherein each groove comprises a groove having a v-shaped transverse cross-section.

23. A load-bearing detent mechanism according to claim 22 wherein said each v-shaped groove has an apex angle of approximately 120°.

24. A load-bearing detent mechanism according to claim 14 wherein each groove comprise a groove having a square-cornered u-shaped cross-section.

25. A load-bearing detent mechanism according to claim 14 wherein each groove comprise a groove having a trapezoidal u-shaped cross-section.

26. A load-bearing detent mechanism according to claim 14 wherein each groove comprise a groove having a curved u-shaped cross-section.

27. A load-bearing detent mechanism according to claim 14 further comprising:

means for rotating said inner member relative to a stationary outer member.

28. A load-bearing detent mechanism according to claim 14 wherein said leaf springs further comprise electrical grounding conductors for attenuators disposed along the grooves.

29. In a switchable attenuator device having a plurality of attenuators selectively rotatable to an operative position, a load-bearing detent mechanism for registering the attenuator device when an attenuator is rotated to the operative position, the load-bearing detent mechanism comprising:

an axially elongated inner member having an outer cylindrical surface;

an axially elongated outer member having an inner cylindrical surface wherein said inner cylindrical surface is coaxial with and encircles said outer cylindrical surface, wherein said attenuator in said operative position forms a portion of an electrical circuit by the creation of electrical connections at each end of said attenuator when said attenuator is rotated into its operative position, and wherein said inner member and said outer member are rotatable relative to each other; and said members having on the juxtaposed surfaces a plurality of grooves extending substantially the lengths of said members parallel to their common axis with the grooves on each surface disposed at angular positions relative to each other groove on that surface about the periphery of the surface;

a conductive leaf spring having a bow in a plane perpendicular to the axis of said members disposed in each of said grooves in one of said surfaces, the bow in said leaf spring protruding sufficiently to engage and seat in a groove in said other member, and means for electrically grounding each end of each of said leaf springs.

30. A load-bearing detent and electrical grounding mechanism for an electrical device wherein said detent mechanism provides and maintains uniform spacing between inner and outer cylinders, said detent and electrical grounding mechanism comprising;

a first elongated cylindrical member providing a first cylindrical surface, a second elongated cylindrical member providing a second cylindrical surface coaxial with said first cylindrical surface, one of said members being disposed about the other of said members, said members being rotatable relative to one another, said members having on their juxtaposed surfaces a plurality of grooves extending substantially the lengths of said members parallel ot their axis with the grooves on each surface disposed at angular positions relative to each other groove on that surface about the periphery of the surface, a conductive spring having a bow in a plane perpendicular to the axis of said members disposed in each of the grooves in the surface of one of said members, the bow in said spring protroding sufficiently to engage and seat in said groove in said other member, means for connecting each of said springs to an electrical ground, at least one attenuator means mounted on said first or said second cylindrical member, means for selectively rotating said at least one attenuator means into an operative position wherein said attenuator means forms a portion of an electrical circuit.

* * * * *